US007267622B2

(12) United States Patent
Hwang

(10) Patent No.: US 7,267,622 B2
(45) Date of Patent: Sep. 11, 2007

(54) GOLF BALL AND METHOD OF MANUFACTURING THE SAME

(75) Inventor: In Hong Hwang, Namyangzu-Shi (KR)

(73) Assignee: Volvik Inc., Daeso-Myun, Eumseong-Gun Chung Cheong Buk Co. (KR)

( * ) Notice: Subject to any disclaimer, the term of this patent is extended or adjusted under 35 U.S.C. 154(b) by 169 days.

(21) Appl. No.: 11/191,723

(22) Filed: Jul. 28, 2005

(65) Prior Publication Data

US 2006/0211516 A1 Sep. 21, 2006

(30) Foreign Application Priority Data

Mar. 18, 2005 (KR) ..... 10-2005-0022536

(51) Int. Cl.
*A63B 37/12* (2006.01)

(52) U.S. Cl. ..... 473/378

(58) Field of Classification Search ..... 473/378–385
See application file for complete search history.

(56) References Cited

U.S. PATENT DOCUMENTS 6,342,019 B1 * 1/2002 Boehm et al. ..... 473/378

6,866,802 B2 * 3/2005 Puniello et al. ..... 264/39

* cited by examiner

*Primary Examiner*—Raeann Trimiew
(74) *Attorney, Agent, or Firm*—Amster Rothstein & Ebenstein, LLP

(57) ABSTRACT

Provided is a golf ball with a transparent cover made of ionomer resin containing 0.02% or less of a pigment or a dyestuff. The surface of the cover of the golf ball is processed using a corona discharge process at a voltage of 90,000V and then together with wedge type grinding media in a revolving hexagonal drum type surface treatment machine to induce microscopic indentations and scratches on the surface of the cover. An anchor coated layer is formed on the surface of the cover using acrylic resin or urethane resin, and a top coated layer is formed on the anchor coated layer using urethane resin. The surface of the golf ball has a number of specula surfaces and thus can induce diffused reflections of light. Therefore, the golf ball appears in dual color due to the color of its core and the color of shadows of dimples. In addition, when the golf ball has circular dimples, the shadows of edges of the circular dimples are revealed as irregular round polygons and are in discord with the original positions of the dimples. Therefore, the golf ball can be easily discriminated even at a distance when landing on the ground in a golf course.

8 Claims, 3 Drawing Sheets

T

N

GOLF BALL AND METHOD OF MANUFACTURING THE SAME

CROSS-REFERENCE TO RELATED PATENT APPLICATIONS

This application claims the benefit of Korean Patent Application No. 10-2005-0022536, filed on Mar. 18, 2005, in the Korean Intellectual Property Office, the disclosure of which is incorporated herein in its entirety by reference.

BACKGROUND OF THE INVENTION

1. Field of the Invention

The present invention relates to a golf ball that has a plurality of dimples on the surface of a transparency cover containing a very small amount of pigment or dyestuff such that the shadows of dimples projected through the cover are in discord with the original positions of the dimples. Thus, especially, in the case of circular dimples, the shapes of shadows of edges of the dimples are revealed as irregular round polygons due to diffused reflection of light in the surface of the cover of the golf ball, in order that the golf ball can be more easily discriminated at a distance in a golf course than a golf ball made using a conventional method.

2. Description of the Related Art

In general, golf balls can be classified according to their structure into a two piece golf ball consisting of a single core and a single cover, a three piece golf ball consisting of dual core and a single cover, a three piece golf ball consisting of a single core and double cover, a four piece golf ball consisting of dual core and double cover, a four piece golf ball consisting of triple core and a single cover, a four piece golf ball consisting of a single core and triple cover, etc. In the past, many golfers used three piece wound golf balls manufactured by winding a stretched rubber thread on a tube of liquid or solid core and covering it with a cover. However, such golf balls lack durability and are manufactured using complicated processes and there are currently very few companies producing such golf balls. Solid cores of two piece, three piece, and four piece golf balls are made from a cis-1,4-polybutadiene rubber which is cured by a co-cross-linking agent, such as an unsaturated carboxylic acid or a metal salt thereof, with the aid of organic peroxide, wherein the rubber may be partially blended with another resin. The core mixture may be blended with an inorganic compound, such as zinc oxide, to control the specific gravity and assist the reaction of the co-cross-linking agent. In addition, various organic or inorganic compounds may be used in the core mixture as fillers or reinforcement materials. An inorganic or organic pigment or dyestuff may be used for coloring the cores, if required.

Meanwhile, in the past, balata rubber was used as a material for the covers of the above-described golf balls. However, ionomer resin is mainly used for the cover at present, owing to its strong physical properties and good durability against chemicals.

Recently, various cover materials, for example, urethane resin or other synthetic resins, or mixtures of these materials, have been used. In a general method of manufacturing a colored golf ball, the above-described cover material is mixed and treated with a suitable organic or inorganic pigment or dyestuff.

In addition to the method of mixing and treating the cover material with a coloring agent, a colored golf ball can be manufactured by coloring the core by adding a pigment or dyestuff or by coating the surface of the core with a paint of a desired color, and covering the colored core with a transparent cover such that the color of the core can be seen through the transparent cover.

Conventional golf balls are usually white and visually monotonous. Because such conventional white golf balls are similar, when 3-4 players play in a field, it is difficult for the players to quickly find their own golf ball in the field after being hit by a golf club.

To overcome this drawback, the colored golf balls are used instead of white golf balls. For example, fluorescent orange golf balls can be used in a field covered with snow because the fluorescent orange golf balls can be easily found in the white snow. In addition to fluorescent orange golf balls, golf balls in various colors are available. However, the appearances of these colored golf balls, which have turbid colors because they are made by merely adding a pigment or a dyestuff to their cover, are not graceful. In addition, such a colored golf ball cannot be easily found if it is buried in its surroundings, such as the green, soil, and others after flying and landing.

There are golf balls available with transparent covers or transparent covers containing a small amount of a fluorescent material. The transparent cover of a golf ball allows the color of the core and a logo or a number printed on the core to be seen so that the color of the core and the logo or the number printed on the core do not change over a long time, and therefore the graceful appearance of the golf ball can be maintained. However, since the core of such a golf ball is colored by adding a pigment or dyestuff or by being coated with a paint and a number or a logo is printed on the surface of the core to be seen through the cover (in general golf balls, a logo or a number is printed on their cover), the color of the golf ball is not distinct when in flight, and the landing point of the golf ball cannot be quickly found. This is because colored golf balls are darker than white golf balls and absorb a larger amount of light and reflect a smaller amount of light than white balls when flying.

This is also related to the phenomenon that dimples on the surface of the cover of a golf ball are seen well at a certain angle and not at other angles (because the angle of reflection of light varies depending on the observation point). This phenomenon may be attributed to that the color of the core and the logo printed on the core are shown through the cover, on the surface of which more regular reflections of light than diffused reflections occur.

Accordingly, in order to easily predict the landing point of such a colored golf ball flying with a back spin, more diffused reflections should be induced on the golf ball to scatter a larger amount of light. Hence, an object that can reflect light can be attached to the cover of the golf ball or the surface of the cover. However, such an object greatly lowers the repulsive elasticity of the golf ball and markedly shortens the carry distance.

SUMMARY OF THE INVENTION

The present invention provides a colored golf ball that can easily scatter the light without a decrease in repulsive elasticity to be easily found when in flight or after landing on the ground.

According to an aspect of the present invention, a golf ball comprises a core; a cover formed of an ionomer resin and having a plurality of dimples on a surface; and a glossy coated layer formed on the surface of the cover, wherein the cover contains 0.02% or less of a pigment or dyestuff, the microscopic indentations and scratches having sizes of 2-10 μm of irregular specula surfaces are formed on the surface of the cover, the coated layer includes an anchor coated layer composed of acrylic resin or urethane resin and a top coated layer composed of urethane resin.

The microscopic scratches and indentations may be formed by corona-discharging the surface of the cover at a voltage of 80,000-120,000V and grinding the surface of the cover using a surface treatment machine.

The anchor coated layer may have a thickness of 5-10 μm. The top coated layer may have a thickness of 8-20 μm.

The dimples on the surface of the cover may have different shapes.

A symbol, such as a character, a sign, etc., may be printed on the surface of the cover. Alternatively, a symbol, such as a character, a sign, etc., may be printed on the surface of the anchor coated layer of the cover.

According to another aspect of the present invention, a method of manufacturing a golf ball comprises forming a core; forming a cover of the core using an ionomer resin to have a plurality of dimples on the surface of the cover; corona-discharging the surface of the cover at a voltage of 80,000-120,000V to form cracks over the surface of the cover; treating the surface of the cover with the cracks together with grinding media in a surface treatment machine revolving at 18-22 rpm to separate the ionomer resin from the cover with the cracks to form microscopic indentations and scratches having sizes of 2-10 μm; washing and drying the cover of the core; coating acrylic resin or urethane resin on the cover of the core to form an anchor coated layer; and coating polyurethane resin on the anchor coated layer to form a top coated layer.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
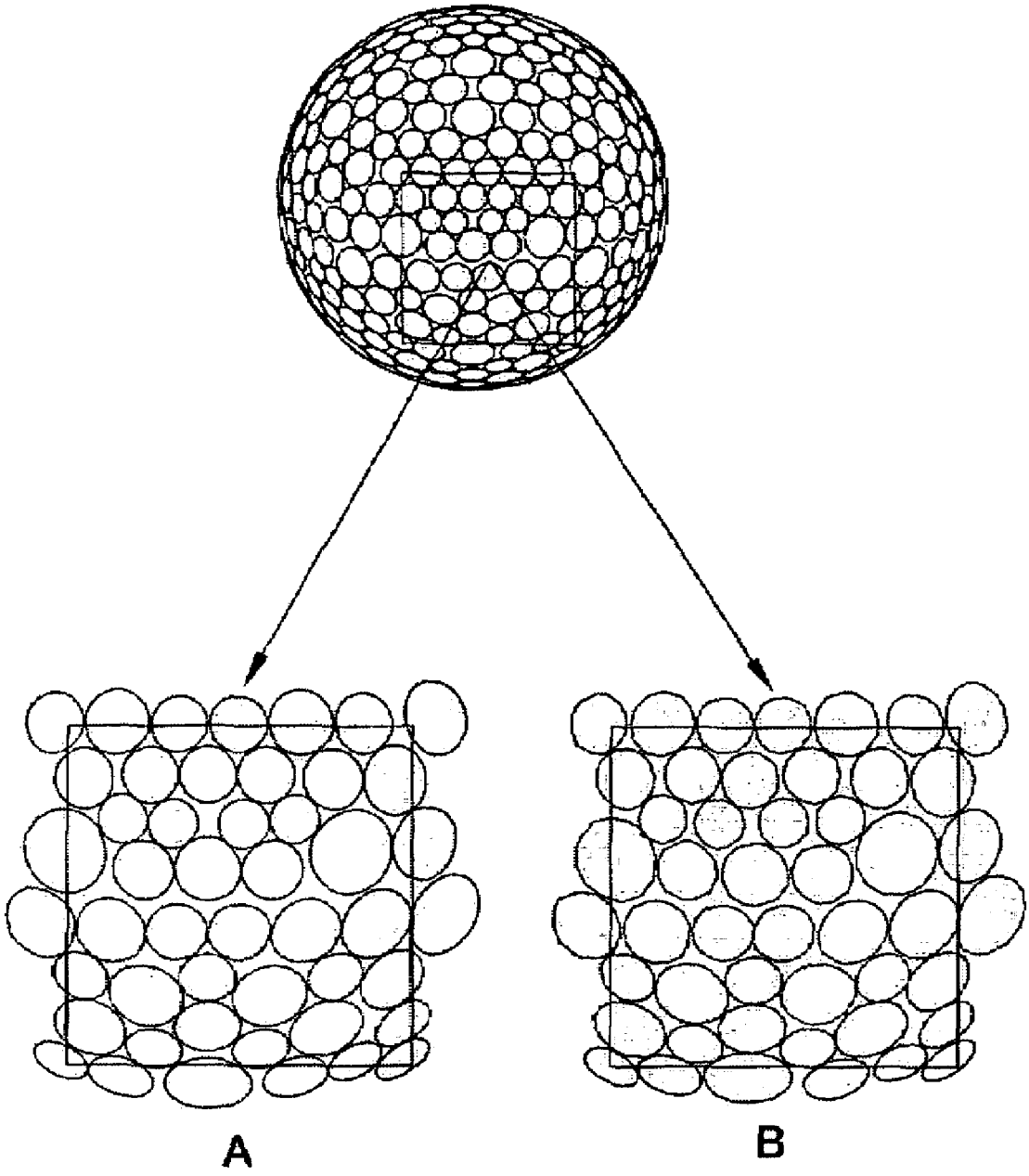
FIG. 1 illustrates a golf ball with circular dimples on its surface according to the present invention, in which "A" is an enlarged view of circular dimples in a portion enclosed by a rectangular, and "B" shows the shadows of the circular dimples in "A" in discord with the original positions of the dimples and the shadows of edges of the dimples being revealed as irregular round polygons, which differ from the shapes of the original circular dimples.

Embodiments of the present invention will be described in detail with reference to the appended drawings.

A golf ball according to the present invention includes a core, a cover, and a coated layer. The golf ball according to the present invention may have a structure of a two piece golf ball consisting of a single core and a single cover, a structure of a three piece golf ball consisting of dual core and a single cover, or a structure of a four piece golf ball consisting of triple core and a single cover. Such golf balls with a single cover are suitable for the present invention to allow the color of the core to be seen through the cover and the shadows of dimples on a surface of the cover to be distinct.

The core may have, but is not limited to, the composition described above. To achieve the object of the present invention, it is important to obtain a core having a uniform surface and color by grinding the surface of the core formed by curing the composition in which an organic or inorganic pigment is dispersed well using a general method, wherein the grinding can be performed using appropriate grinding machine, such as a center-less grinder. This is because such a core having uniform surface and color allows the shadows of dimples formed on the core through the cover to be seen well at a long distance.

The term "core" referred to throughout the specification of the present invention means a single core, dual core, or triple core. In addition, the surface of the core refers to the surface of the outermost core. The dimension of the core, such as diameter, is the total for all the cores. These definitions will apply hereinafter.

The cover fully covers the core. A plurality of dimples are formed on the surface of the cover. A proper material for the cover is ionomer resin. The ionomer resin is a kind of ionic ethylene copolymer obtained by combining unsaturated carboxylic acid to ethylene and neutralizing at least a portion of the carboxylic acid into a metal salt. In other words, the ionomer resin is a ternary copolymer consisting of ethylene, an unsaturated carboxylic acid, and a metal salt of the unsaturated carboxylic acid, or a quaternary copolymer consisting of ethylene, an unsaturated carboxylic acid, an ester of the unsaturated carboxylic acid, and a metal salt of the unsaturated carboxylic acid. Examples of the unsaturated carboxylic acid include mono-basic acids, such as an acrylic acid, a methacrylic acid, etc., and di-basic acids, such as maleic acid, fumaric acid, etc. The content of the unsaturated carboxylic acid, which is represented by weight % regardless of whether it is neutralized or not, may be in a range of 6-20% by weight. Examples of the metal for the metal salt of the unsaturated carboxylic acid include monovalent metals, such as Na, Li, K, etc., and divalent metals, such as Zn, Mg, etc. In general, the degree of neutralization of commercially available metallic ions is in a range of 20-80%. In general, the ester of the unsaturated carboxylic acid is an alkyl ester of the unsaturated carboxylic acid wherein an alkyl group containing 1~10 carbon atoms, such as methyl, ethyl, propyl, etc., are suitable for use. The ionomer resin is commercially available under the brand names "Surlyn" (Dupont) and "IOTEK" (Exxon). As the ionomer resin contains a larger amount of acid, the ionomer resin becomes mechanically stronger and more transparent. However, if the resin contains too much acid, it is too hard to obtain a golf ball that feels soft. Therefore, an ionomer resin suitable for use in the present invention may contain about 14-15% of acid.

In this amount range of acid in the ionomer resin, the golf ball according to the present invention can have an appropriate transparency and hardness to lead sufficient microscopic indentations and scratches for light scattering during a surface treatment process and to be pleasant to the touch. In order to coordinate the color of the core, a transparent organic or inorganic pigment or dyestuff is used by 0.005-0.02% by weight of the ionomer resin.

A pigment or dyestuff of the cover used same as the color of the core has a similar effect to the color of the core. When observing the color of the core or a resin layer coated on the core from a side, not the front, of the ball through the ionomer resin of the cover containing less than 0.005% of a pigment or dyestuff, the color of the golf ball is seen turbid as if it contains a small amount of a white component. This is because crystals in the ionomer resin affect the transmission of light depending on the angle of view. As a result, the color of the core is seen turbid, which is not the original color of the core. Meanwhile, if 0.02% or greater of a pigment or dyestuff is used, the color of the cover is too dark for the color of the core to be seen, the shadows of the dimples on the cover to appear, and a brilliant specula surface to be formed. In addition to a pigment, a small amount of an anti-aging agent, such as an antioxidant, a heat stabilizer, a UV absorber, etc. may be used if needed.

Meanwhile, the solid structure of ionomer resin consists of polyethylene crystals, amorphous hydrocarbons, and ionic lamellar clusters (thin, flaky, folded ionic clusters), like thin flakes. In the manufacturing of a golf ball according to the present invention, using more smaller crystals than larger crystals makes scattering of light easier. In general, when the core of the golf ball is covered with a cover, the cover is formed of a molten cover material using compression molding or injection molding. However, injection molding is preferred in the present invention.

When performing the injection molding, if a molten ionomer resin used as a material for the cover is rapidly cooled to 15° C. or lower in a mold, crystals disperse and cannot grow well. On the contrary, if the molten ionomer resin is slowly cooled at a high temperature, crystals grow well and become larger. Therefore, it is preferable that, after the molding, the molten ionomer resin is cooled to 15° C. or lower over a long time, for example, at least 40 seconds or longer. This is related to the thermal characteristics of the ionomer resin. If the cooling time is too short, although the surface of the cover can be cooled, the heat still remains in an inner part of the cover near the core, and the crystals continue to grow. As a result, many large crystals are formed. These large crystals hinder the light scattering and make the color of the core dull and the shadows of dimples on the cover indistinct. The cooling temperature and the cooling time depend on the thickness of the cover. In the present invention, an appropriate thickness of the cover may be in a range of 0.8-1.7 mm. If the thickness of the cover is greater than 1.7 mm, the color of the core and the shadows of dimples are seen indistinct. If the thickness of the cover is smaller than 0.8 mm, the cover is fragile and is broken when hit.

Unlike conventional golf ball manufacturing methods, the following additional processes are performed to form microscopic irregular indentations and scratches, which induce diffused reflections of light, on the surface of the cover of a golf ball formed of the ionomer resin using the molding under the above-described conditions.

First, a corona discharge process is performed on the surface of the cover of a rolling golf ball at a high voltage of 80,000~120,000V for 2-5 seconds to form fine cracks having a depth of a few micrometers on the surface of the cover made of ionomer resin. In an embodiment of the present invention, a Big Bend Zapper machine (available from Big Bend Machine Co., U.S.A.) was used in this corona discharge process.

Figure 2:
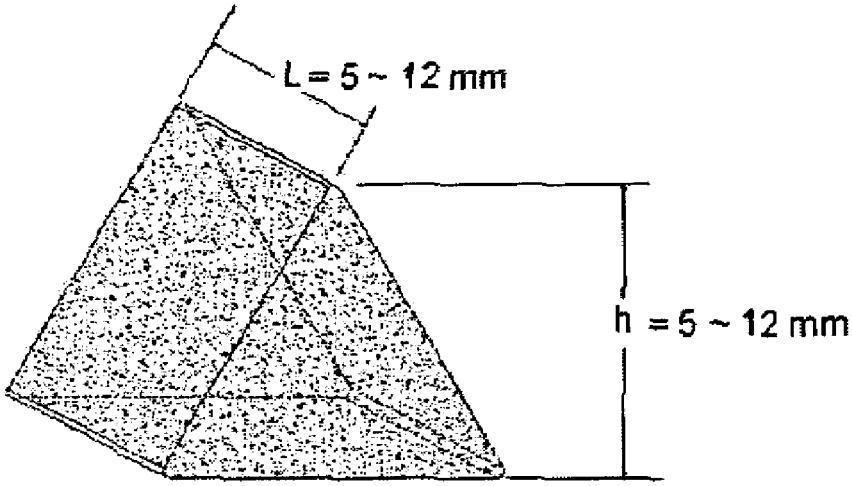
FIG. 2 shows the dimension of a wedge type grinding medium put into a hexagonal drum type revolving surface treatment machine in a surface treatment process according to the present invention, in which "h" represents the height of a triangular side of the grinding medium, "L" represents the length of the grinding medium, the largest grinding medium used in the present invention has h=12 mm and L=12 mm, and the smallest grinding medium has h=5 mm and L=5 mm.
Figure 4:
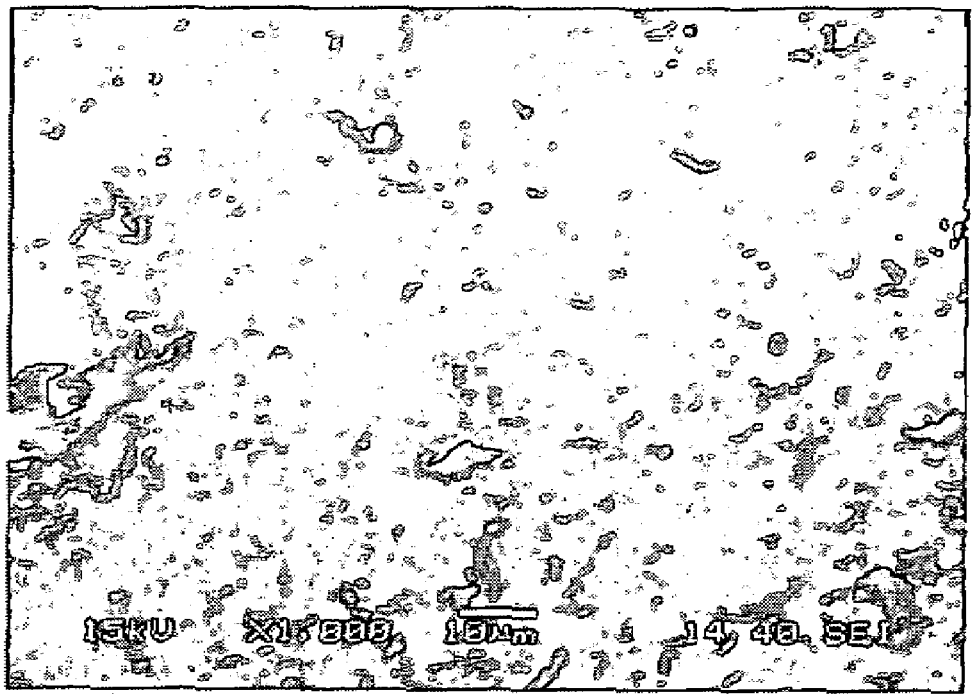
FIG. 4 is SEM photographs (×1,000) of the surfaces of golf balls, in which a photograph denoted by T shows microscopic cracks and indentations having sizes of 2~7 μm on the surface of a cover of a golf ball according to the present invention manufactured using injection molding, processed using corona discharging and then a hexagonal drum type revolving surface treatment machine, and finally washed, and a photograph denoted by N shows a smooth surface of a cover of a conventional golf ball manufactured using injection molding and then washed using a conventional method.
Figure 4:
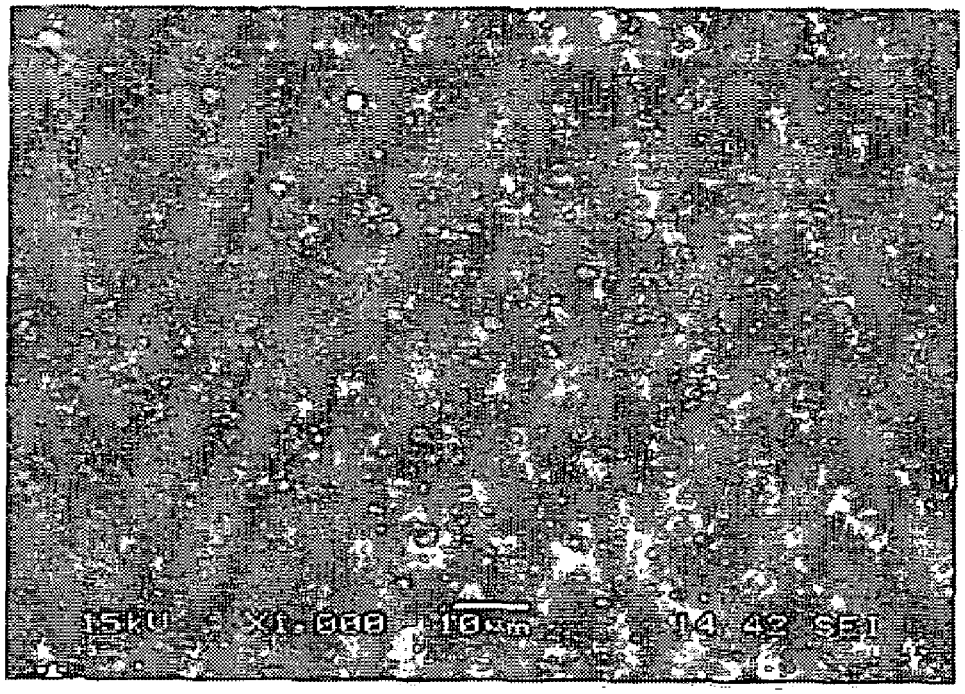

Next, microscopic indentations and scratches are formed on the cover with the fine cracks made of the ionomer resin to induce substantial diffused reflections of light. To this end, the corona discharged golf ball is ground with wedge type grinding media as shown in FIG. 2 for 30-90 minutes in a hexagonal drum type, revolving surface treatment machine revolving at 18-22 rpm (revolution per minute). The grinding media are formed by sintering a mixture of slit clay containing kaolinite as a main component and diamond powder. The slit clay refers to slime having a particle diameter of 0.02-0.002 mm smaller than sand and larger than mud. The degree of grinding is determined according to the granularity of the diamond powder and the shape of the grinding media. Using large grinding media and small grinding media together is advantageous to increase the speed of the surface treatment. In addition, to facilitate the formation of fine scratches and indentations on the cover, the golf ball is soaked in a 0.1-0.05% surfactant solution by weight of water, which is used as a detergent, such that the surfactant permeates into the golf ball. Suitable surfactants that can be used in the present invention include nonionic surfactants, such as polyoxyethylene sorbitan monostearate or polyoxyethylene sorbitan monooleate. Golf balls and such grinding media put into the hexagonal drum type, revolving surface treatment machine are slowly rotated while being soaked in the surfactant solution. The golf balls roll upward and tumble down due to their weight and collide with each other between the grinding media, thereby being scratched, pressed, and grinded resulting in various patterns of damage on their surface. The ionomer resin composing the surface of the golf ball with microscopic cracks is separated by sharp edges of the grinding media, thereby resulting in microscopic indentations and scratches over the surface of the cover of the golf ball. Through the above-described processes, a number of microscopic indentations and scratches having sizes of 2-10 μm are formed over the surface of the cover. The hexagonal drum type, revolving surface treatment machine used above is available from Volvik Co. in Korea. In the hexagonal drum type, revolving surface treatment machine, the ionomer resin of the cover with the microscopic cracks formed on the outermost surface thereof through the above-described corona discharge process is completely separated in a pattern as shown in "T" in FIG. 4. As a result, golf balls having larger specula surfaces than those of conventional golf balls due to a number of indentations formed on their surface are obtained. The increased specula surface of the golf ball induces lots of diffused reflection of light. In a conventional method of manufacturing golf balls, after forming a cover on the core using a colored material by injection molding or compression molding, the surface of the golf ball is washed using an appropriate washing apparatus to remove oily and dirty substances and dried, thereby resulting in the golf ball with a smooth surface as shown in "N" in FIG. 4. In the method of manufacturing golf balls according to the present invention, after removing the substances from the surface of the golf ball through a washing process using an appropriate washer, such as barrel machine, and drying the golf ball, as in conventional methods, an acrylic resin emulsion was coated on the golf ball and dried to form an anchor coated layer having a thickness of about 5-10 μm.

The acrylic resin emulsion used in the present invention is a mixture of an anionic modified acrylic copolymer emulsion (NeoCryl, brand name of Avecia Co., Netherlands) with a multi-functional azilidine liquid cross-linker (Cross-linker CX-100, brand name of Avecia Co., Netherlands) as a reinforcing agent. A symbol, such as a logo, a number, a character, etc., is printed on the surface of the anchor coated layer using a printer, a two-component urethane resin solution was spray coated on the anchor coated layer and dried to form a top coated layer having a thickness of about 8-20 μm. Next, the resulting golf ball was aged in a curing room at a temperature of 35-40° C. for 24-36 hours to obtain a complete product. Alternatively, symbols may be printed on the external surface of the cover.

The two-component urethane resin solution used in the present invention is a solution of polyester polyol (Urethane Top Clear W, brand name of Jokwang Paint Co., Korea) and polyisocyanate (UH 1807, brand name of Jokwang Paint Co., Korea), which is a kind of hexamethylene diisocyanate used as a hardener, in an organic solvent. This two-component urethane resin solution used to form the top coated layer provides more tough and glossy coating surface after the drying and aging processes. The top coated layer then protects the printed surface, improves the durability of the golf ball, assists diffused reflections of light, and makes the shadows of dimples distinct.

Table 1 below shows the differences between a method of manufacturing golf balls in Example according to the present invention and a conventional method of manufacturing golf balls in Comparative Example. In addition, the discriminabilities of the golf balls according to Example and Comparative Example when playing rounds of golf were evaluated by 20 amateur golfers. The results are shown in Table 2.

TABLE 1

| Manufacturing Process | Dimensions/ Processing Time | Example | Comparative Example |
|---|---|---|---|
| Colored core (Pink E 0.1%) (*1) | Diameter - 39.4 mm | ○ | ○ |
| White cover ($TiO_2$ 2.5%) | Thickness - 1.65 mm | — | ○ |
| Colored cover (Pink E 0.01%) | Thickness - 1.65 mm | ○ | — |
| Buffing (Parting line) | | ○ | ○ |
| Corona discharge (90,000 V) | 20 sec | ○ | — |
| Surface treatment (Revolving hexagonal drum S.T. M/C) (*2) | 60 min | ○ | — |
| Washing (Barrel washing M/C) | 30 min | ○ | ○ |
| Drying (40° C.) | 4 hr | ○ | ○ |
| Anchor coating (Spray coating) | Thickness - 8 μm | ○ | ○ |
| Printing (Logo, number, etc.) | | ○ | ○ |
| Top coating | Thickness - 15 μm | ○ | ○ |
| Aging (35~40° C.) | 36 hr | ○ | ○ |

(*1) Pink E: a kind of organic pigment available from Clarient Co., Germany
(*2) S.T. M/C: Surface treatment Machine (available from Volvik Co., Korea)
○: A corresponding process is performed; and
—: A corresponding process is not performed.

TABLE 2

| Item | Discriminability | |
|---|---|---|
| | Example | Comparative Example |
| In flight (Driver hit) | ○ | ○ |
| 150-M Distance (after landing) | Δ | X |
| 100-M Distance (after landing) | ○ | Δ |
| 50-M Distance (after landing) | ○ | ○ |

○: Easy,
Δ: Moderate,
X: Difficult

Figure 3:
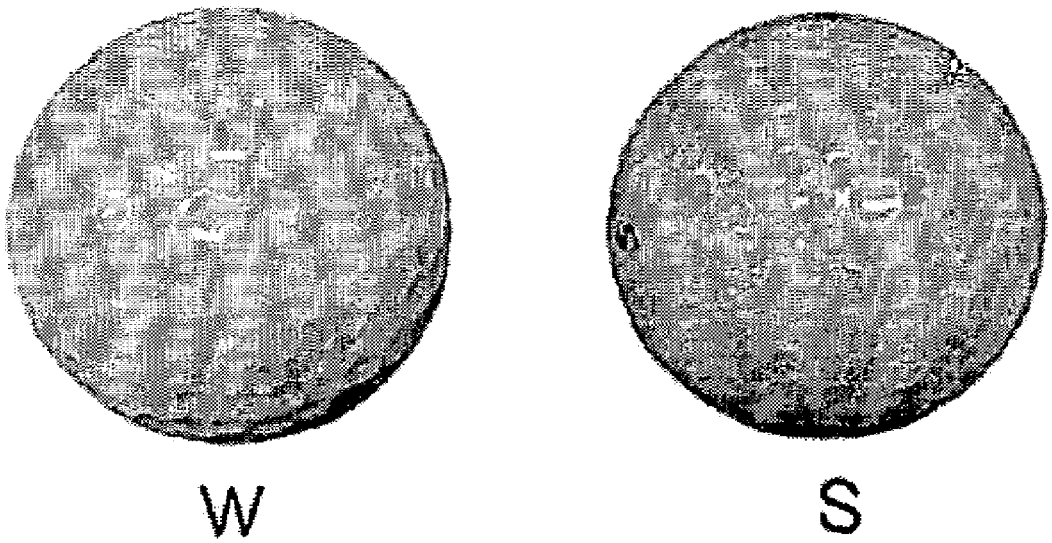
FIG. 3 shows a white golf ball (W) manufactured using a conventional method and a golf ball (S) manufactured using a method according to the present invention.

As described above, a golf ball according to the present invention can induce diffused reflections of light due to specula surfaces on its transparent cover containing a small amount of a pigment. Therefore, the golf ball appears in dual color due to the color of its core and the color of shadows of dimples. In addition, when the golf ball has circular dimples as shown in B of FIG. 1, the shadows of edges of the circular dimples are revealed as irregular round polygons and are in discord with the original positions of the dimples. The surface of the golf ball ("S" in FIG. 3) manufactured using the method according to the present invention can be easily discriminated compared with the surface of a golf ball ("W" in FIG. 3) manufactured using conventional methods. The golf ball according to the present invention can be easily discriminated when in flight or at a distance when landing on the ground. Therefore, it is easy to find the landing point of the ball.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A golf ball comprising:

a core;

a cover formed of an ionomer resin and having a plurality of dimples on a surface; and a glossy coated layer formed on the surface of the cover, wherein the cover contains 0.02% or less of a pigment or dyestuff, the microscopic indentations and scratches having sizes of 2-10 μm are formed on the surface of the cover, the coated layer includes an anchor coated layer composed of acrylic resin or urethane resin and a top coated layer composed of urethane resin, and the microscopic indentations and scratches form irregular specula surfaces.

2. The golf ball of claim 1, wherein the microscopic indentations and scratches are formed by corona-discharging the surface of the cover at a voltage of 80,000-120,000V and grinding the surface of the cover using a surface treatment machine.

3. The golf ball of claim 1, wherein the anchor coated layer has a thickness of 5-10 μm.

4. The golf ball of claim 1, wherein the top coated layer has a thickness of 8-20 μm.

5. The golf ball of claim 1, wherein the dimples on the surface of the cover have various shapes.

6. The golf ball of claim 1, wherein a symbol, a character, or a sign is printed on the surface of the cover.

7. The golf ball of claim 1, wherein a symbol, a character, or a sign is printed on the surface of the anchor coated layer of the cover.

8. A method of manufacturing a golf ball, the method comprising:

forming a core;

forming a cover of the core using an ionomer resin to have a plurality of dimples on the surface of the cover;

corona-discharging the surface of the cover at a voltage of 80,000-120,000V to form cracks over the surface of the cover;

treating the surface of the cover with the cracks together with grinding media in a surface treatment machine revolving at 18-22 rpm to separate the ionomer resin from the cover with the cracks to form microscopic indentations and scratches having sizes of 2-10 μm;

washing and drying the cover of the core;

coating acrylic resin or urethane resin on the cover of the core to form an anchor coated layer; and coating urethane resin on the anchor coated layer to form a top coated layer.

* * * * *